United States Patent [19]

Arnott

[11] Patent Number: 4,680,032

[45] Date of Patent: Jul. 14, 1987

[54] PROCESS FOR HEAT TREATING TEXTILE SUBSTRATES TO GIVE A COLORED PATTERN

[75] Inventor: Robert C. Arnott, Spartanburg, S.C.

[73] Assignee: Milliken Research Corporation, Spartanburg, S.C.

[21] Appl. No.: 792,619

[22] Filed: Oct. 24, 1985

Related U.S. Application Data

[63] Continuation of Ser. No. 476,828, Mar. 18, 1983, abandoned.

[51] Int. Cl.[4] ..... D06P 5/00

[52] U.S. Cl. ..... 8/486; 8/481; 8/922; 8/478

[58] Field of Search ..... 8/486, 481

[56] References Cited

U.S. PATENT DOCUMENTS

| | | | |
|---|---|---|---|
| 3,619,103 | 11/1971 | Williams et al. | 8/14 |
| 3,880,579 | 4/1975 | Renaut | 8/2.5 |
| 3,888,623 | 6/1975 | Clarke et al. | 8/2.5 |
| 3,989,448 | 9/1976 | Bohrn | 8/14 |
| 4,086,112 | 4/1978 | Porter | 156/73.1 |
| 4,260,390 | 4/1981 | Lewis | 8/481 |
| 4,303,459 | 12/1981 | Kleber | 156/227 |
| 4,364,156 | 12/1982 | Greenway et al. | 26/2 |
| 4,417,897 | 11/1983 | Stahl et al. | 8/464 |
| 4,452,605 | 6/1984 | Love | 8/494 |
| 4,499,637 | 2/1985 | Greenway | 26/2 R |

*Primary Examiner*—A. Lionel Clingman

*Attorney, Agent, or Firm*—George M. Fisher; H. William Petry

[57] ABSTRACT

A single, uniform application of dye is employed to generate a pattern dyed substrate wherein the pattern and pattern-complementary areas are dyed by the same dye, but at different levels of fixation. Dye is uniformly applied to the substrate, and optionally dried, without fixation. Heat is applied to the substrate uniformly as well as selectively in a pattern configuration. The uniform heating serves to fix the dye in the pattern-complementary areas at a pre-determined level. Selective heating in pattern areas serves to fix the dye at a higher level of concentration in pattern areas than is found in the pattern-complementary areas, resulting in a multi-tone effect. Optionally, the heating in pattern areas may be sufficient to cause shrinkage or other thermally-induced physical modification to the substrate, in perfect registry with the pattern-dyed areas.

12 Claims, 1 Drawing Figure

PROCESS FOR HEAT TREATING TEXTILE SUBSTRATES TO GIVE A COLORED PATTERN

This is a continuation of Ser. No. 476,828, filed Mar. 18, 1983, and now abandoned.

This invention relates to a process for dyeing textile substrates in a pattern configuration. In one embodiment thereof, this invention relates to a process for simultaneously dyeing and thermally modifying components of a textile substrate in a pattern configuration, and in substantially perfect registry, while also dyeing pattern-complementary areas.

BACKGROUND OF THE INVENTION

Various techniques are known for dyeing a textile substrate in a pattern configuration. For example, it is well known that textile substrates may be dyed in a pattern configuration using a heat transfer printing process. In such processes, heat-sublimable dyes may be arranged in a pattern on an inert sheet such as paper. The paper is then brought into close association with the substrate surface to be dyed under conditions of heat and pressure. The dye sublimes and is transferred to the substrate in the vapor phase, where it condenses and is absorbed into the fibers comprising the substrate.

Using another technique, U.S. Pat. No. 3,619,103, to Williams, et al. describes a process for producing heat-induced effects on textiles or the like by means of one or more heated rollers. According to the teachings of Williams, et al., migration, heat fixation, and development of dyes on a textile substrate may be greatly accellerated through the use of such roller. The process of Williams et al., however, relates to a process wherein dye migration from one portion of the substrate to another is employed as the primary means to achieve a desired pattern. As a result of the liquid phase migration phenomenon, patterning the face of a fabric necessarily involves the patterning of the back of the fabric as well, and patterned areas tend to exhibit slightly "fuzzy" or indistinct edges. Also, large expanses of dyed fabric exhibit an "edge effect", wherein the edge of the dyed area contains more dye than the interior of such area, making such areas exhibit light and dark variations of the color rather than a single, uniform color. Furthermore, Williams, et al. does not suggest that an unpatterned textile substrate may be applied with dye in a pattern configuration and, substantially simultaneously, the dye in the dyed areas fixed, without the need for an additional process step. The process of Williams, et al. is also somewhat limiting in the sense that the substrate must generally be wet or have a high moisture content to permit patterning, and the time required by Williams, et al. for the preferred source of heat, i.e., the roller, to transfer sufficient heat to the substrate to initiate appreciable migration is relatively slow when compared to the process of the invention disclosed herein.

Processes which utilize the localized application of heat to impart a visual surface effect on a textile substrate are also common. Embossing techniques in which a heated roll or other heated member is pressed against the surface of a textile substrate in order to impart various visual surface effects such as surface sculpturing are well known in the art. As an example of patterning by means of heated air, U.S. Pat. No. 4,364,156 to Greenway, et al. discloses an apparatus for heat-treating the surface of a textile substrate by the pattern-wise application of a heated fluid such as air from selected locations along a slot in an elongate manifold, the fluid containing sufficient thermal energy to shrink or otherwise permanently thermally modify the visual appearance of the substrate in those areas contacted by the fluid. It is believed this technique results in a much more uniform heat treatment of the substrate as a result of, among other things, superior heat transfer to the individual yarns comprising the substrate surface. Under many circumstances, however, a higher degree of visual contrast in the thermally modified areas is desired than is commonly obtained using this technique.

It is desirable under some circumstances to modify the color or hue of the areas contacted by the heated fluid streams, relative to the color or hue of the background. Differential dyeing techniques, wherein a substrate comprising synthetic fibers is initially heat treated to modify the quantity of dye later adsorbed by the treated fibers in a post-treatment dyeing step, are known in the art. Such differential dyeing techniques present a substantial difficulty in observing or inspecting the pattern areas for quality control purposes before the fabric is dyed. Prior to dyeing, some textile fabrics, when pattern-wise heat treated sufficiently to change significantly the degree of dye take-up in those heat treated areas, exhibit little visual contrast between the treated and untreated areas, making it extremely difficult to observe, and therefore inspect, the patterned areas prior to the dyeing step. The process of this invention eliminates this problem by applying the dye to the fabric prior to the patterning step rather than following such step. The dye which has been subjected to heat appears visually different than, and often darker than, dye which has had no such heat exposure, thereby making the heat treated areas readily visible during the patterning step.

Described herein is a novel process for patterning textile substrates wherein selected areas having enhanced contrast or a multi-tone pattern effect may be generated by the local, pattern-wise application of heat to areas of the substrate wherein a dyed has been applied. This process may also be employed where simultaneous dyeing and sculpturing, in perfect registry, is desired. This process overcomes the disadvantages recited above in connection with alternative dyeing processes.

Further details of the process of this invention may be understood after reading the following description and referring to the accompanying FIG. 1, which is a process flow diagram for applying a dyed pattern, with a dyed background of a lighter variation of the same color as the pattern, to an undyed substrate.

DETAILED DESCRIPTION

Figure 1:
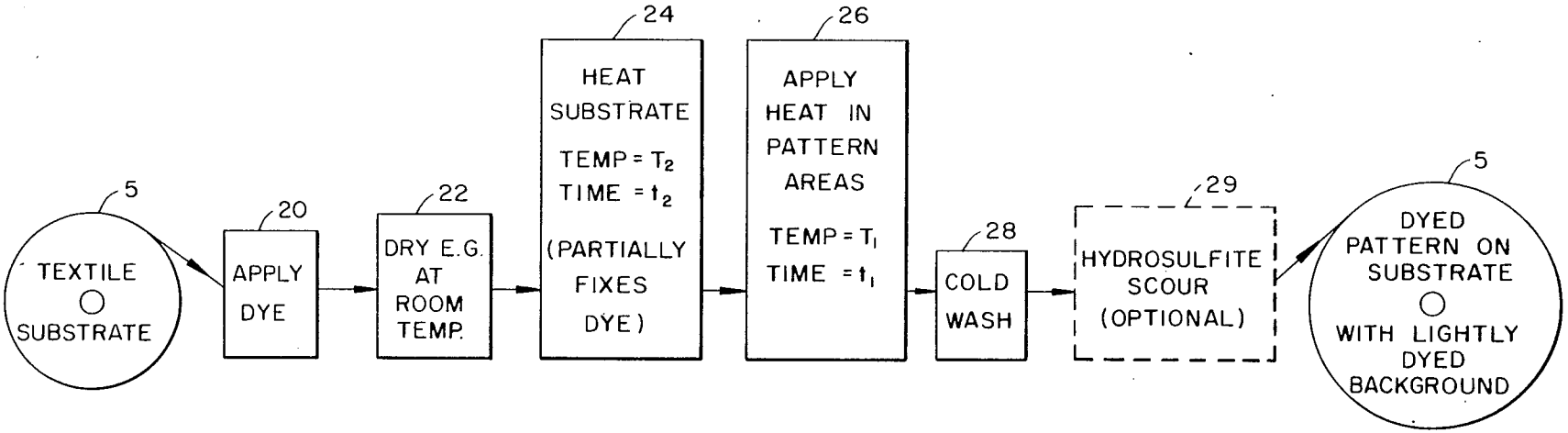

FIG. 1 schematically depicts a process in which a textile fabric is transformed into a dyed, patterned fabric in which the patterned areas of the substrate are a pre-determined color, and the background or pattern-complementary areas of the substrate are a color which is results from fixing a quantity of the same dye as that residing in the patterned areas, but which has been fixed at a fixation level substantially different from the fixation level of the patterned area. If a red dye is used to pattern a previously undyed substrate, for example, the resulting patterned substrate may show a red patterned area against a pink (i.e., red dye fixed at a lower level) background. If a substrate which had been previously dyed a light or pale yellow were used in the above example and the fixation levels in the pattern areas is high, the same process steps may yield a substantially red pattern against an orange (i.e., yellow plus pink dye) background.

In the embodiment depicted in FIG. 1, an appropriate dye is applied at process block 20 to an undyed textile substrate comprised of a thermoplastic material, such as a textile fabric made from fibers of polyester, acrylonitrile, nylon 6, nylon 6,6, etc. Appropriate dyes for this purpose are considered to be those dyes which would customarily be used to dye such materials in conventional dyeing processes. The dye may be applied by means of a gravure or foam coating operation, by spraying, or by other conventional means for applying an appropriate dye to the desired textile substrate. It is generally preferred that the dye be applied uniformly if consistent, reproducible results are desired. As indicated at process block 22, the fabric may then be allowed to dry, preferably without exposure to elevated temperatures, although such drying may be considered optional. The amount of residual moisture left in the substrate may be adjusted to suit the specific process, and may be somewhat dictated by, for example, the means by which heat is applied to the substrate to fix the desired quantity of dye in a later process step. Additional moisture in the substrate may require the application of additional heat to achieve the desired dye fixation level or state of thermal modification of the substrate surface. It should be emphasized that the process of this invention does not require that the dyed substrate remain wet or be capable of permitting liquid phase migration of the dye over the substrate surface. It is considered an important advantage of this invention that the substrate, after being substantially uniformly dyed, may be dried and then shipped or stored for patterning at a later time or place. If only a slightly tinted background is desired, it is important that the dye is dried, and the substrate handled or stored, under conditions which do not fix excessive quantities of the applied dye. For example, in dyeing polyester using disperse dyes drying at temperatures less than about 220° F. or so have been found to be generally satisfactory, although lower temperatures may be found necessary under certain conditions. It should be understood, however, that certain dye systems do not depend upon elevated temperatures to "fix" in certain substrate materials, i.e., mere contact of the dye with the substrate may be sufficient to cause at least partial fixation of the dye on the substrate.

To ensure reproducibility and control, it is preferred that the drying process be carried out in a manner which results in no significant fixing of the dye on the substrate, regardless of the background color level desired, although, if desired, the drying step may be used to establish this background color level by being used as a dye fixation step as well, perhaps in place of the process of process block 24.

In the sense used herein, the term "fix" and its derivatives (e.g., "fixation") are intended to relate to the entry of the dye molecule into the individual constituent fibers or components of the substrate to a sufficient degree to render the dye associated with those fibers relatively light-fast and wash-fast. Reference to a "fixation level" as that term is used herein is intended to mean the relative quantity of dye which has been fixed on a specified area of the substrate. Areas in which large numbers of dye molecules per unit area of substrate surface have been fixed therefore may be said to have a high dye fixation level. Conversely, areas having a relatively small quantity, per unit area of substrate surface, of dye which has been fixed may be said to have a low dye fixation level. Generally, areas of relatively high dye fixation levels will appear visually darker or more saturated when compared with areas of relatively low dye fixation levels, assuming the process began with a white or light colored substrate and the same dye is used in all areas.

After the dye solution has been allowed to dry, the applied dye may be heated, in a controlled, uniform manner, to fix the dye at a relatively low, uniform level and establish the desired background color, as indicated at process block 24. Additional, local heating, either immediately or later, in a pattern configuration, as depicted in process block 26, fixes to a higher level the partially fixed dye on the substrate in the appropriate pattern areas, and thereby establishes a visually darker or more saturated color in the pattern area when compared with the background or pattern-complementary areas. Although the Figure indicates, that the uniform heating to establish the background color (process block 24) preceeds the patterning step (process block 26), it is foreseen that the pattern-wise application of heat in the pattern areas may be done first, followed by a uniform heating of the substrate to establish the desired background color (i.e., process blocks 24 and 26 may be interchanged).

Following this localized dye fixing process, the substrate may be washed in a cold wash to remove substantially all the unfixed dye. This results in a textile substrate which carries a patterned area containing a predetermined quantity or concentration per unit area of a fixed dyestuff which is viewed against a background or pattern-complementary area of the substrate which has been dyed with the same dye used in the pattern areas, but fixed at a level substantially lower than the fixation level of the patterned area.

An optional scouring step is indicated at process block 29. This step may be employed to clear the fabric, if desired.

It is also possible to pattern areas by both dyeing the pattern area and by inducing a thermally induced modification (e.g., inducing longitudinal shrinking, or localized minor melting or fusing, or pile yarn entangling) to at least some of the constituent fibers in the same pattern area. Where dyeing is to be combined with one or more of these other thermally induced effects, sufficient heat must be transferred to and absorbed by the substrate to produce two effects: (1) physical modification of the textile substrate surface as, for example, by substantially shrinking the yarn components of the substrate, by initiating limited melting of the yarn components, or by other thermally-induced physical changes to the constituent fibers or elements of the textile substrate, and (2) the fixing of the desired quantity of dye to a desired, pre-determined level, the dye having been applied and optionally dried in the previous steps of the process, described above. These two effects are achieved substantially simultaneously so far as the process steps of this invention are concerned, and are, of course, localized to those areas of the substrate where the heat has been directed in pattern configuration. Therefore, the physical modification to the constituent textile components of the substrate and the fixing of the dye applied to the substrate lie in exact registry, each having been the result of the same localized application of heat.

It is contemplated that the heat may be non-uniformly applied within a given pattern area, resulting in pattern areas in which a given dye has been fixed at different levels of fixation, or in which the substrate has been thermally modified to different degrees.

It should be understood that any suitable method for applying sufficient heat to the substrate to fix the desired quantity of dye as well as generate thermally induced modifications to the substrate may be used in connection with this invention. For example, a laser of the appropriate type may be modulated according to pattern information and scanned over the surface of the substrate to induce fixation of the dye and, optionally, fiber shrinkage, fusing, etc., in a desired pattern configuration. An infra-red heat source, perhaps used in conjunction with a mask or stencil defining the desired pattern, may also be used. Where uniform fixation, e.g., of background areas, is desired, the heat may be applied as a part of the drying step (process block 22) or via heated roll or heat transfer press or other means as a separate step (process block 24).

Preferably, the method or means by which the heat may be applied to the substrate in a pattern-wise configuration to affect a chosen dye fixation level is one which will result in a controlled, reproducible quantity of heat being transferred to the pre-selected areas of the substrate without having an undesired effect on the substrate, for example, the crushing of the fabric pile if a pile fabric is used. It is also preferred that the method or means be capable of applying heat uniformly applied across the length and width of the substrate, and that the heat be capable of being distributed within the substrate to permit fixation of dye dhroughout the substrate structure, when and where such fixation is desired. If maximum versatility is desired, it is preferred that the heat source be one which allows for the modulation of the temperature and/or exposure times within selected portions of the pattern area, which would permit, for example, gradual shadings or variations in color within a given pattern area.

One means for applying the requisite amount of heat which has been found to be particularly advantageous involves the use of selectively controlled streams of heated fluid, such as hot air, which impinge on the substrate in a pattern configuration. For example, a reservoir of pressurized heated air may be closely positioned across the width of a substrate to which dye has been applied. Individual streams of relatively hot air may be directed from the reservoir onto the substrate surface. These individual streams may be regulated by introducing a second stream of air or other fluid, at a relatively lower temperature and higher pressure, into a respective selected stream of the heated air, for purposes of blocking, diluting, or otherwise interrupting the flow of the stream of heated air. The individual streams of relatively cool air may each be controlled by a respective valve which is actuated in response to pattern information supplied by a computer or other means. By controlling the actuation and pressure of these cooler air streams, the amount of heat transferred to selected areas of the substrate by the hot air can be regulated, for example, by effectively diluting or rapidly interrupting the hot air stream before it impinges on the substrate, or by completely blocking or deflecting the path of the hot air stream. In this way, areas of the substrate may be subjected to various degrees of heating, and therefore various levels of dye fixation and thermal modification, i.e., shrinking, melting, etc., resulting in the capacity to produce a wide variety of visual surface effects. Examples of suitable apparatus which may be used for producing streams of heated air as described above are disclosed in commonly assigned U.S. Pat. No. 4,364,156 and commonly, assigned U.S. Patent Application Ser. No. 253,135, filed Apr. 13, 1981, now abandoned, which disclosures are hereby incorporated by reference.

Use of the process of the present invention may be illustrated by the following examples, which are specific and not intended to be limiting. Unless otherwise specified, the apparatus used to apply the desired heat was one similar in overall operation to the hot air apparatus disclosed in U.S. Pat. No. 4,364,156 and U.S. Patent Application Ser. No. 253,135. The elongate heated air manifold was positioned approximately 0.20 inches from the substrate surface, and air heated to approximately the indicated temperature was directed toward the substrate surface at a pressure of approximately 0.8 p.s.i.g through a slot which extended along the length of the manifold. The air temperatures given were measured immediately prior to the air entering the manifold, and may therefore be somewhat higher than the temperature of the air which actually impinged on the substrate. The temperature of the air needed to achieve the desired results will of course depend upon the type of dye used, the level of fixation desired, the nature of the substrate, the nature of the additional thermally induced modifications desired (if any), etc. The term "sculpturing" as used hereinbelow is intended as a generic term to include longitudinal shrinking or localized melting or fusing of individual yarns, or yarn entangling, or other processes which would result in the patterning of the substrate surface.

EXAMPLE 1

A padding bath was made up according to the following formula: 950 grams water, 50 grams of the coloring agent Foron Blue SBGL (powdered) a product of Sandoz Color and chemicals, Inc. of E. Hanover, N.J. 07936, having a Color Index Name of Disperse Blue 73. A sample fabric manufactured by Milliken & Company, Spartanburg, S.C. 29304 was chosen. It is identified as Style 2651, Interlock, a 100% polyester knit having a weight of 4 oz./yd.$^2$. The fabric was wet out by dipping into a padding bath and run through a padding device set at a pad pressure of 30 lbs. The fabric was air dried at 70° F. and processed with streams of heated air from the apparatus described above. Using a temperature of 770° F. and a treatment time of 0.030 seconds. Samples of this fabric were then treated in a laboratory heat transfer press under the conditions shown below to yield a patterned fabric with lower degrees of fixation in the pattern complementary areas relative to the highest degree of fixation on the pattern or image area. The fabrics were then washed in a household washing machine using cold water and a household laundry detergent to removed unfixed dye, and dried.

| Fabric | Time | Temperature | Results Color/Color/Background/Image/Sculpturing |
|---|---|---|---|
| Control | — | — | None/Dark Blue/Excellent |
| 1 | 30 seconds | 130° C. | Very Light Blue/Dark Blue/Excellent |
| 2 | 30 seconds | 150° C. | Light Blue/Dark Blue/Excellent |
| 3 | 30 seconds | 170° C. | Medium Blue/Dark Blue/Excellent |

EXAMPLE 2

The procedure in Example 1 was repeated except that the coloring agent in the bath was Teraprint Red 3G (liquid dispersion) a product of Ciba Geigy Corporation, Greensboro, N.C. 27419. The following results were obtained:

| Fabric | Time | Temperature | Results Color/Color/Background/Image/Sculpturing |
|---|---|---|---|
| Control | — | — | None/Dark Red/Excellent |
| 1 | 30 seconds | 130° C. | Very Light Red/Dark Red/Excellent |
| 2 | 30 seconds | 150° C. | Light Red/Dark Red/Excellent |
| 3 | 30 seconds | 170° C. | Medium Red/Dark Red/Excellent |

I claim:

1. A method for dyeing the surface of a thermoplastic textile substrate in a desired pattern configuration comprising the steps of:

(a) applying, substantially uniformly, a heat fixable dye material to said substrate surface without fixing said dye;

(b) applying heat substantially uniformly to said substrate surface carrying said dye material, said heat being sufficient to fix a quantity of said dye material substantially uniformly over said substrate surface;

(c) applying heat selectively to said substrate surface in areas defining said desired pattern configuration, said heat being sufficient to increase the fixation level of said dye material in said areas while maintaining said dye material on said substrate surface outside said areas substantially unchanged level of fixation and concentration.

2. The method of claim 1 wherein unfixed dye material is removed from said substrate surface as a final step.

3. The method of claim 1 wherein said dye material is applied in liquid form.

4. The method of claim 3 which further comprises the step, following the application of said dye material to said substrate and prior to the fixing of said dye material, of drying said substrate surface to a substantially dry condition while leaving said applied dye material on said substrate surface substantially uniformly distributed and in substantially unfixed condition.

5. The method of claim 1 wherein said heat is applied to said areas non-uniformly.

6. The method of claim 1 wherein said heat applied to said substrate surface in said areas defining said desired pattern configuration is sufficient to permanently thermally modify said substrate surface in at least portions of said areas.

7. The method of claim 6 wherein said heat is sufficient to substantially longitudinally shrink components of said substrate surface.

8. The method of claim 6 wherein said heat is sufficient to melt portions of components of said substrate surface.

9. The method of claim 1 wherein said heat applied to said substrate surface in said areas defining said desired pattern configuration is applied by selective impingement by a stream of heated fluid.

10. The method of claim 9 wherein the temperature of said heated fluid applied to said areas is varied in accordance with pattern information.

11. The method of claim 4 wherein said heat generated on said substrate surface in said areas defining said desired pattern configuration is applied by a heated mass pressed against said substrate surface in said areas.

12. A method for dyeing the surface of a thermoplastic textile sdbstrate in a desired pattern configuration comprising the sequential steps of:

(a) applying, substantially uniformly, a heat fixable liquid dye material to said substrate surface without fixing said dye;

(b) drying said substrate surface to a substantially dry condition by the uniform application of heat to said surface, said heat being sufficient to fix a quantity of said dye material substantially uniformly over said substrate surface; and (c) applying heat selectively to said substrate surface in said areas defining said desired pattern configuration, said heat being sufficient to fix further quantities of said dye material in said areas while maintaining said dye material on said substrate surface outside said areas in substantially the same degree of fixation and concentration.

* * * * *